US005431315A

United States Patent [19]

Chun et al.

[11] Patent Number: 5,431,315

[45] Date of Patent: Jul. 11, 1995

[54] APPARATUS FOR APPLYING UNIFORM METAL COATINGS

[75] Inventors: Jung-Hoon Chun, Sudbury, Mass.; Christian H. Passow, Batavia, Ill.; Manish H. Bhatia, Okemos, Mich.

[73] Assignee: Massachusetts Institute of Technology, Cambridge, Mass.

[21] Appl. No.: 57,738

[22] Filed: May 15, 1993

[51] Int. Cl.[6] ..... C23C 4/00

[52] U.S. Cl. ..... 222/590; 118/620

[58] Field of Search ..... 427/475; 222/590, 603; 266/202; 118/620, 623, 627, 302; 264/9

[56] References Cited

U.S. PATENT DOCUMENTS

| | | | |
|---|---|---|---|
| 4,264,641 | 4/1981 | Mahoney et al. | 427/483 |
| 4,762,553 | 8/1988 | Savage et al. | 75/336 |
| 4,871,489 | 10/1989 | Ketcham | 264/9 |
| 4,886,547 | 12/1989 | Mizukami et al. | 75/334 |
| 5,062,936 | 11/1991 | Beaty et al. | 204/164 |
| 5,266,098 | 11/1993 | Chun et al. | 75/335 |

FOREIGN PATENT DOCUMENTS 1587125 4/1981 United Kingdom .

*Primary Examiner*—John Niebling
*Assistant Examiner*—Brendan Mee
*Attorney, Agent, or Firm*—Robert F. O'Connell

[57] ABSTRACT

An apparatus for coating the surface of a substrate with a coating material, which apparatus includes a chamber into which the material is supplied in a pressurized molten state from a source thereof. The molten material is subjected to vibrations within the chamber and is forced out of the chamber through one or more orifices so that the vibration breaks up the molten material exiting from the orifices into uniform sized droplets. A charging plate places a charge on each of the droplets and supplies the charged droplets via one or more corresponding orifices in the charging plate for use in coating the substrate. The charging of the droplets maintains the uniform size of the droplets as they are applied to the substrate. The droplets are further maintained in an oxygen-free atmosphere as they pass from the chamber to and through the charging plate. Each of the components of the apparatus is made as a separate module so that the overall apparatus can be readily assembled and disassembled.

16 Claims, 3 Drawing Sheets

APPARATUS FOR APPLYING UNIFORM METAL COATINGS

This invention was made with government support under Grant Number DDM-901490 awarded by the National Science Foundation. The government has certain rights in the invention.

This invention relates generally to an apparatus for applying coatings to substrates and, more particularly, to an apparatus for applying in a continuous manner very uniform metal coatings to substrates of various shapes and sizes which may be positioned at a variety of different orientations.

BACKGROUND OF THE INVENTION

The application of metal coatings to substrates is often performed as a batch process operation requiring the submersion of the substrate in a tank of molten metal, sometimes referred to as a "hot dip" coating technique. Such an approach normally does not produce coatings of uniform thickness and can only be used with certain substrates, the sizes of which are small enough to fit into the tanks. Moreover, over extended periods of time, the metal in the tank becomes contaminated and must periodically be discarded and replaced with fresh, clean metal.

Electroplating processes have also been used for such coating purposes. However, while such an electroplating process can produce generally uniform coatings, it is relatively expensive and cannot normally be used to provide relatively thick coatings. Moreover, such process also requires the use of a tank which again limits the size of the substrate being coated.

While spray coating devices have been used to apply coatings, they normally are used for spraying non-metallic paints and often cannot readily achieve a uniform thickness since the spray droplets are generally not uniform in size. Moreover, the apparatus used is often cumbersome and the spray orifices tend to become clogged and must be laboriously cleaned, often in situ, and if the orifices become too clogged, they are usually inconvenient to replace.

It is desirable to develop a coating apparatus which can provide very uniformly sized metal droplets so that, when appropriately applied to a substrate, they produce a coating having uniformly sized droplets and a coating of uniform thickness. Such apparatus should be relatively inexpensive to make and use and be able to coat substrates of various sizes, which substrates may be positioned at various orientations. The apparatus further should permit easy replacement of parts thereof so that maintenance costs can be minimized.

BRIEF SUMMARY OF THE INVENTION

This invention provides a compact and efficient spray coating apparatus which is designed to make an effective use of a droplet generation technique as generally described in U.S. patent application Ser. No. 07/817,517, previously filed by us on Jan. 7, 1992, which application is incorporated herein by reference.

A technique is described therein for producing and maintaining charged, uniformly sized metal droplets for use in a spray chamber, the droplet formation process being controlled by a suitable monitoring system. The technique generally involves the liquefying of metal in a container having at least one droplet-forming spray orifice, the charging of the liquified metal, and the forcing of the liquified metal through the orifice. Vibration is imposed on the liquid which causes the liquid to form metal droplets which can then be used for a variety of purposes.

In accordance with the present invention, a particularly effective apparatus using the principles of the metal droplet forming technique described in our previous application has been developed for use in a manner which will most effectively produce a uniform metal coating on a substrate, the thickness of which coating can be suitably controlled. In accordance with the design, the apparatus utilizes a plurality of modular parts. The overall apparatus can be made at reasonable cost and can be readily assembled and disassembled so that parts can be easily replaced and maintenance costs can be minimized. The apparatus is devised to be reasonably compact and made so that it can be used to produce droplets for spraying downwardly, upwardly or generally horizontally so that substrates of different shapes, sizes and orientations can be coated as desired.

BRIEF DESCRIPTION OF THE DRAWINGS

The invention can be described in more detail with the help of the accompanying drawings wherein.

DESCRIPTION OF THE PREFERRED EMBODIMENTS

A particular preferred embodiment of the invention is described with reference to FIGS. 1–7 and is designed to produce the desired coating operation in an efficient and effective manner.

Such an apparatus, which would be capable of rapidly, dependably, and cost effectively coating parts of any shape and size and at any orientation in industrial applications, for example, has least the following features.

First of all, the apparatus is arranged to produce its own shroud of inert gas so that a spray chamber is not required. Without the need for a spray chamber, it is possible to rapidly present and remove parts, e.g., substrates, which are to be coated to and from the apparatus for the coating operation and to coat relatively large parts that otherwise would not fit into a spray chamber.

Moreover, such apparatus is arranged to filter the molten metal used therein to prevent impurities from clogging the spray orifices and is constructed so that a filter and orifices therein can be rapidly replaced if and when they do become clogged.

Further, such an apparatus is relatively inexpensive both to construct and to maintain, the maintenance costs being minimized by making the replaceable filter and orifices as simple as possible.

Further, such apparatus is preferably modular in structure so that it can be readily assembled and disassembled, the structure being configured to permit coating of any size and parts of any shape.

Further, such apparatus is capable of spray coating not only vertically downward, but also horizontally and vertically upward so that it can coat all sides as well as the tops and bottoms of parts.

A particular preferred embodiment of a spray coating system providing such features in accordance with the invention is shown in FIGS. 1–7. Such system includes a supply of pressurized molten metal, a generally flat spray head having an array of orifices on its front face, a heated tube to transport the metal melt to the spray head, further heaters for the molten metal therein, and means for imposing vibrations on the melt, means for charging the droplets, and means for generating a shroud of inert gas, as discussed in more detail below.

Figure 1:
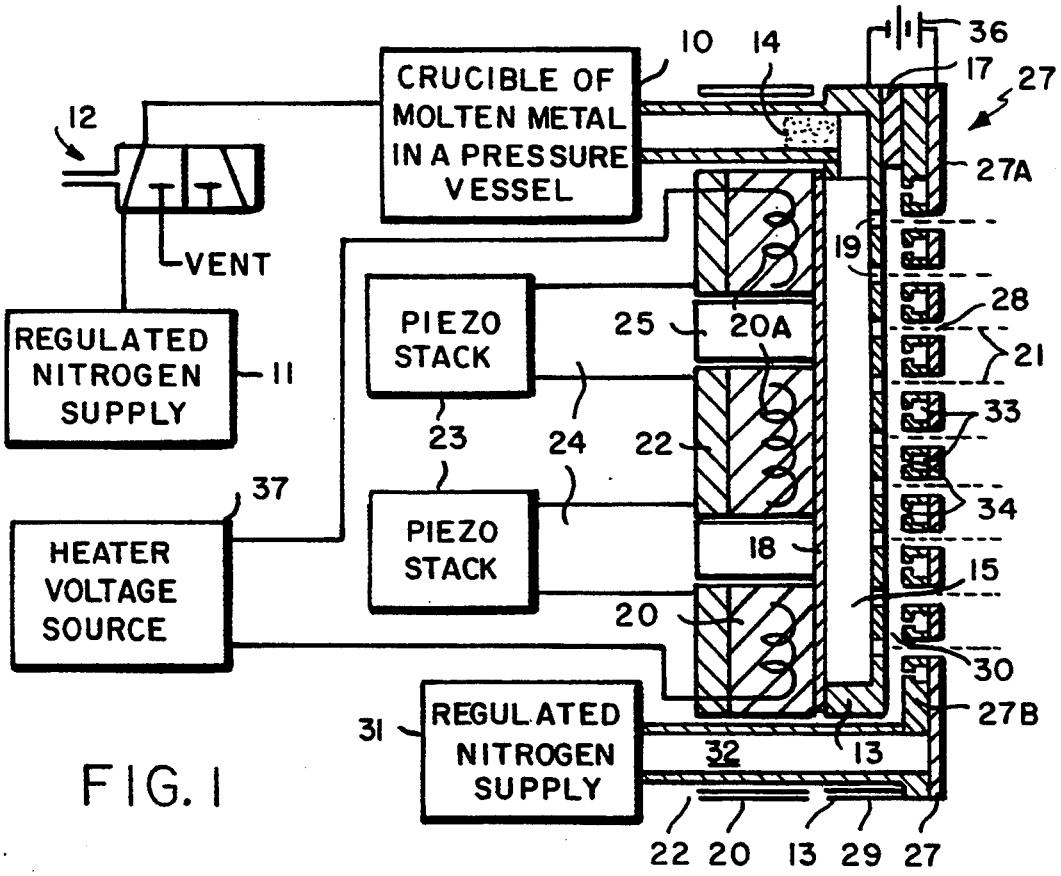
FIG. 1 shows a view partially in section and partially using block diagrams of a preferred embodiment of the invention.

Thus, as can be seen in FIG. 1, a crucible (not shown) containing molten metal is placed in a pressurized vessel 10 supplied with nitrogen gas under pressure from a supply 11 thereof via a venting valve 12. The molten metal is supplied from vessel 10 to a spray head 13 via a ceramic filter 14 into a melt chamber 15.

Figure 2A:
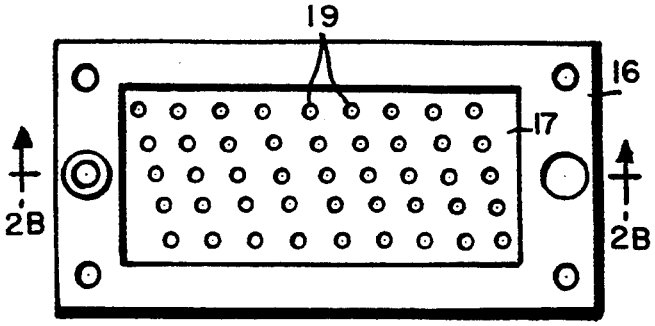
FIG. 2A shows a plan view of a portion of the invention in FIG. 1.
Figure 2B:
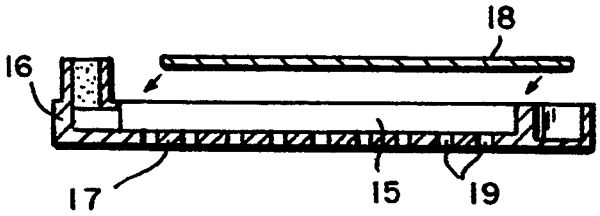
FIG. 2B shows a view in section of the portion depicted in FIG. 2A.
Figure 3:
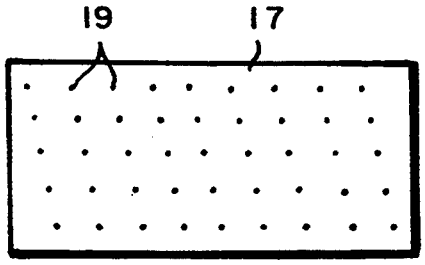
FIG. 3 shows a plan view of another portion of the invention in FIG. 1.

Spray head 13 comprises a stainless steel frame 16 having a thin stainless steel plate 17 at its front and a thicker stainless steel plate 18 at its back, as shown also in FIGS. 2A, 2B and 3. The chamber 15 between the two plates is filled with the pressurized and filtered molten metal. The metal passing through ceramic filter 14 has impurities therein removed as the metal enters the spray head. Front plate 17 has an array of orifices 19 therein, the orifices being formed using a suitable EDM machine, for example, as would be known in the art.

Figure 4A:
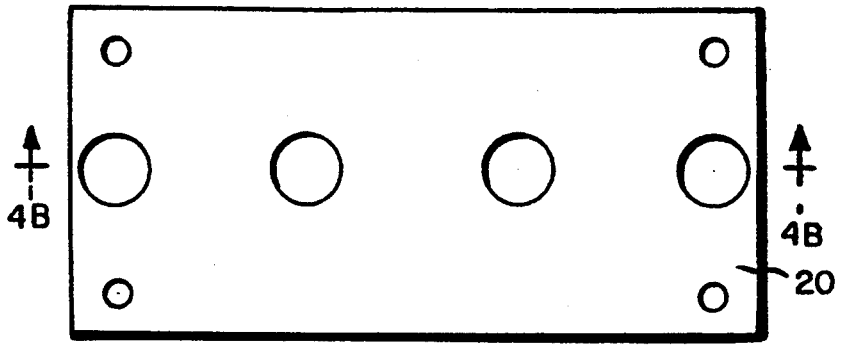
FIG. 4A shows a plan view of still another portion of the invention in FIG. 1.
Figure 4B:
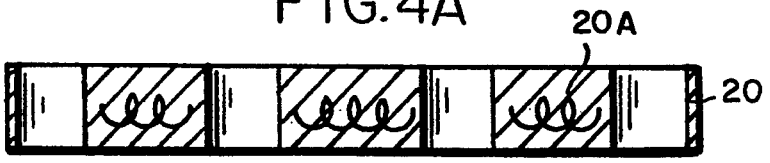
FIG. 4B shows a view in section of the portion depicted in FIG. 4A.
Figure 5A:
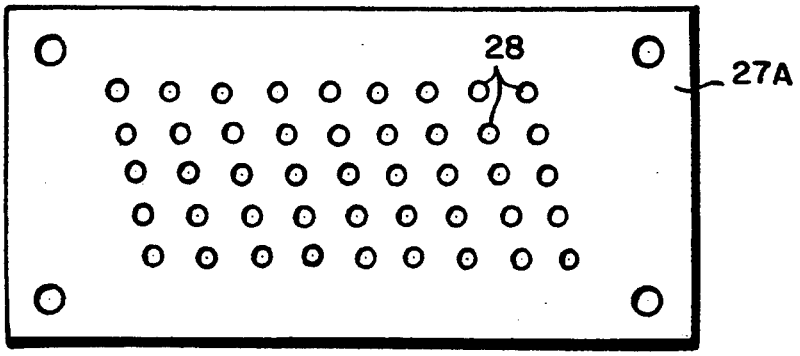
FIG. 5A shows a plan view of still another portion of the invention in FIG. 1.
Figure 5B:
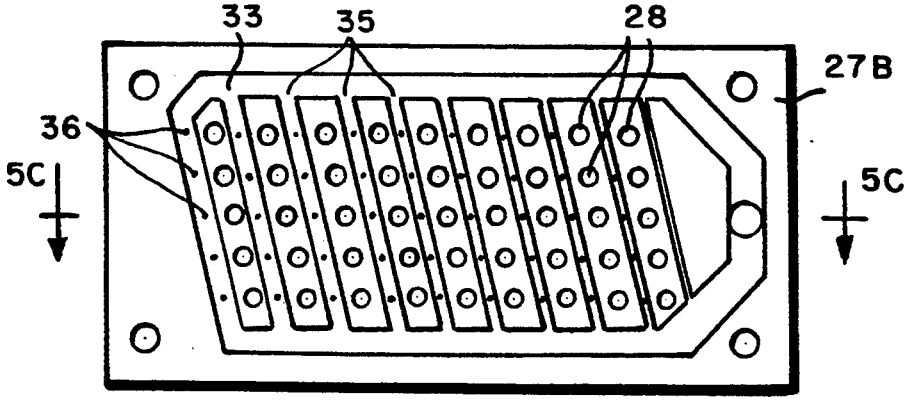
FIG. 5B shows a plan view of still another portion of the invention used together with the portion depicted in FIG. 5A.
Figure 5C:
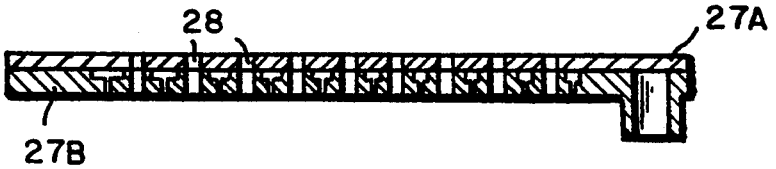
FIG. 5C shows a view in section of the combined portions depicted in FIGS. 5A and 5B.

A resistance heater plate 20, having appropriate electric heater elements 20A embedded therein and connected to a voltage source 37 (FIG. 1) as shown in FIGS. 4A and 4B, is bolted to the back of the spray head 13 to maintain the metal in the spray head in a molten state. Because the spray head is relatively thin, it is not difficult to maintain the temperature near the orifice at a high enough level for spraying.

The pressure on the melt in pressure vessel 10 drives the melt through the orifices 19 of the spray head at a velocity which is dependent thereon so as to form laminar jets 21 thereof (FIG. 1). These jets are broken into uniform droplets by vibrations that are created by a vibration plate 22 having one or more stacks 23 of piezo-electric elements shown in FIGS. 1 and 6B. Vibrations are transmitted down stiff rods 24 through holes 25 in the vibration plate 22 and heater plate 20 to the back plate 18 of the spray head 13. The vibrations created in back plate 18 are then transmitted through the melt to the region of the orifices. The piezo-electric transducer stacks 23 and the vibration transmission rods 24 are mounted on plate 22 which is in turn suitably bolted behind the heating plate to the spray head 13. The sizes of droplets are determined by the size of the orifices, the velocity of the jets and the frequency of vibration that is used so that if the orifices are of uniform size, the velocity of each of the jets therefrom is the same, and the same frequency of vibration is applied thereto, the sizes of the droplets are uniform.

Figure 6A:
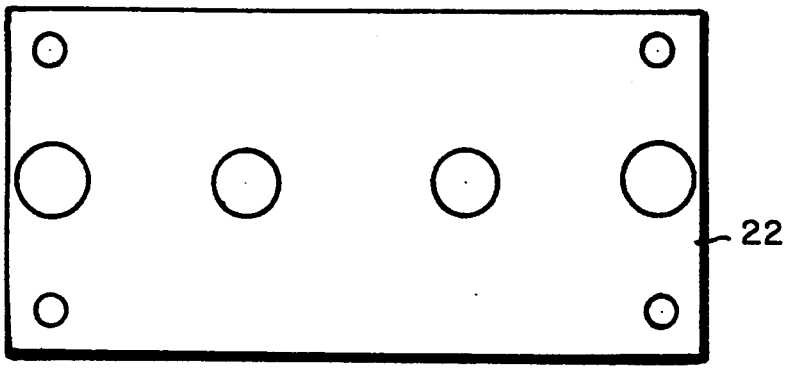
FIG. 6A shows a plan view of still another portion of the invention in FIG. 1.
Figure 6B:
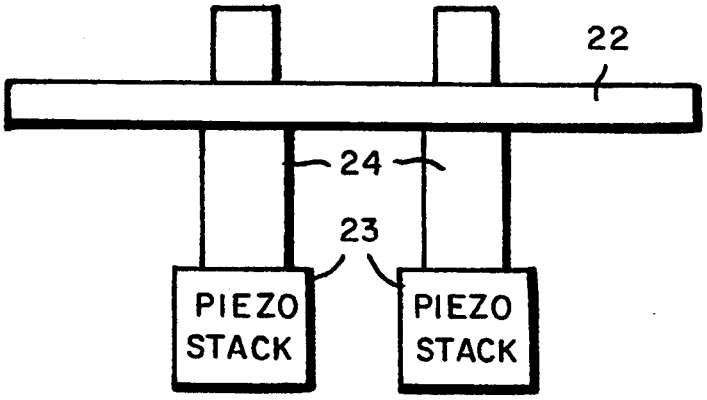
FIG. 6B shows a plan and block diagram view of still another portion of the invention of FIG. 1.
Figure 7A:
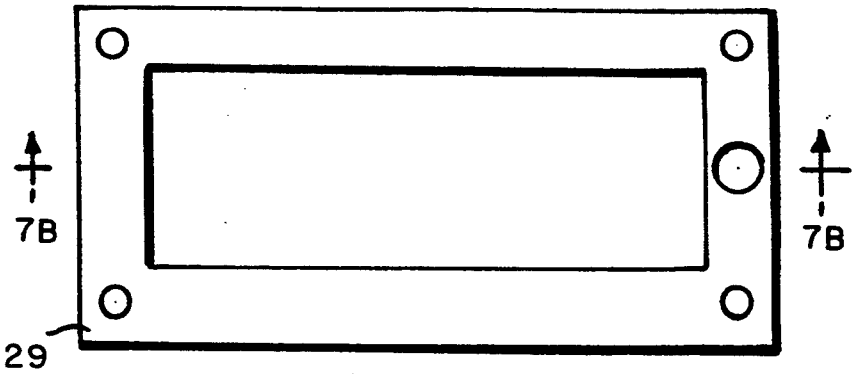
FIG. 7A shows a plan view of still another portion of the invention of FIG. 1.
Figure 7B:
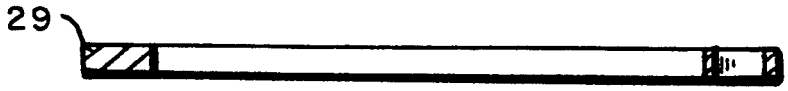
FIG. 7B shows a view in section of the portion depicted in FIG. 7A.

The droplets of molten metal from chamber 15 which pass through orifices 19 are charged by using a charging plate 27, comprising a front plate 27A and a back plate 27B, bolted to the front of the spray head as shown in FIGS. 1 and 6. The charging front and back plates have a plurality of holes 28 therein through which a jet of molten metal passes, the plates being positioned so that the jets break into droplets as they pass through their respective holes. When the charging plate 27 is held at a selected voltage level with respect to the spray head, as supplied from a voltage source 36, the combination of the voltage applied to the charging plate and the electrical capacitance which is present between charging plate 27 and each jet creates a charge at the tip of the jets. As the droplets break free, due to the vibration applied thereto, each droplet retains a portion of the charge that has been created at the tip of its respective jet.

A hollow rectangular glass or ceramic spacer plate 29 (FIGS. 1 and 7A and 7B), spaces the charging plate away from the spray head and insulates the charging plate and the spray head from each other. Insulating spacer 29 seals around the edges of the charging plate 27 and thereby forms a volume 30 (FIG. 1) between the front orifice plate 17 and charging plate 27 which volume is only open to the atmosphere via the charging plate. Since oxide formation is only a problem up until the point at which the jets break into droplets, it is possible to shroud the jets as they pass from the orifice plate to the charging plate by continually flushing the volume 30 with nitrogen. The nitrogen can be supplied from a source 31 thereof through a supply line 32 to a network of passages 33 in the charging plate, nitrogen gas being thereby injected through an array of ports 34 in back plate 27B into volume 30. The passages and ports are sized and positioned to create an oxygen free atmosphere for all of the spray jets. The passages in the charging plate are formed by milling channels in the back plate 27A and then by constructing the charging plate by welding the front and back plates together.

The charging plate is arranged so as to place a charge on each of the uniformly sized droplets that are created by the vibration operation, the charges thereby assuring that the droplets are not attracted to each other so that they do not merge, or agglomerate, so as to form larger and non-uniformly sized particles. Thus, by causing the droplets to be repelled from each other, the charging operation maintains the uniform shape and size of the droplets as they exit from the apparatus. The uniform droplets, which can then be directed to the surface of a substrate, thereby provide for a desired uniform coating thereof on such substrate surface, the thickness of the coating being effectively controlled by controlling the number of orifices the diameter of the orifices, the velocity of the jets exiting from the orifices, and the speed of travel of the substrate as it passes adjacent the output of the apparatus, i.e., such control determines the amount of molten metal, e.g., the number of droplets reaching each region of the surface per unit of time.

In the particular embodiment of the apparatus described above, an effective charging voltage has been formed to lie within a range from about 300–500 volts.

Nozzle sizes from about 53–100 microns have proved effective with spacings of about 1–3 mm. between adjacent orifices. The velocity of the particles, as controlled by the pressure on the molten metal in chamber 15, has been found to be effective if controlled to produce velocities in a range from about 5–15 meters per second. The temperature of molten zinc, for example, in chamber 15 ranges from about 450–500 Celsius. Effective vibration frequencies used in the apparatus can lie within a range from about 8–25 kHz.

The coating process as performed by the apparatus depicted in FIGS. 1–7 can effectively compete with both electroplating and hot dip coating processes of the prior art. While electroplating processes produce coatings that are uniform (although they tend to be less uniform at corners) and that do not react with the substrate to which they are applied, such processes can not, however, produce the relatively thick coatings, produced by the invention, e.g., coatings up to thicknesses of about 10 μm or greater, and can only be used to coat parts that will fit into the electroplating tank that is used therein.

While hot-dip processes can produce relatively thick coatings, the coatings are less uniform than those produced by electroplating processes and, moreover, they often react with the substrate to which they are applied. Further, as in electroplating processes, hot-dip processes can only be used to coat parts that will fit into the hot-dip coating tank that is used and over a period of time the metal in the tank becomes contaminated and must periodically be discarded and replaced with fresh, clean metal.

In contrast, the spray coating apparatus of the invention provides a very flexible means for applying effective coatings. It can apply either thick or thin coatings and can apply these coatings at relatively high rates. As mentioned above, the thickness of the coating and the rate at which it is applied can be controlled, for example, by varying the number of orifices, the diameter of the orifices, the velocity of the jets exiting therefrom, and the rate at which the substrate is moved past the spray.

The apparatus is also capable of applying coatings which have uniform thickness, which uniformity is achieved by electrically charging the droplets so that, in flight, they distribute themselves in a uniform manner. In using multiple rows of orifices, the uniformity of the coatings can be further enhanced by offsetting the rows thereof as shown in FIG. 3.

For some applications, coatings that react with their substrates are preferred. However, for other applications, non-reacting coatings are considered superior. The apparatus of the invention can form both reacting and non-reacting coatings. The amount of reaction between the coating and substrate can be controlled by varying the temperature of the droplets and the temperature of the substrate.

Because the apparatus of the invention operates as a continuous process, without the need for a tank, and not as a batch process which would require a dipping or electroplating tank, the apparatus can be used to apply coatings to various shapes and parts of any size or length. By not requiring the use of a tank, contamination problems and material waste problems are also eliminated. The spraying apparatus of the invention always applies fresh, clean metal and, when properly sized and aligned, can achieve very high yields.

For a specific application, for example, the uniform droplet coating apparatus of the invention can be used as an effective means for applying galvanic coatings to a wide variety of steel sheets or other steel shapes and/or parts. More specifically, it can be valuable as a means for applying galvanic coatings to complex steel assemblies or as an "in-line" part of a continuous bar or sheet steel producing operation. In such applications, while the apparatus can be used to produce a zinc coating, the apparatus can be made of suitable materials which would permit the coating of any metal or metal alloy. Accordingly, the apparatus is an effective means for applying a wide variety of metallic coatings.

While the specific embodiment described above represents a preferred embodiment of the invention, modifications thereto may occur as those in the art within the spirit and scope of the invention. Hence, the invention is not to be construed as limited to the specific embodiment described, except as defined by the appended claims.

What is claimed is:

1. An apparatus for coating a substrate comprising a source of molten metal material;

a chamber having one or more orifices at one wall thereof;

means for supplying said molten metal material under pressure to said chamber;

heating means for maintaining said material in said chamber at a temperature to maintain the material in a molten state;

means for vibrating another wall of said chamber oppositely disposed with respect to said one wall to vibrate the molten material in said chamber, said vibrating means being thermally insulated from said another wall and said vibrating material being forced under pressure through the orifices of said chamber wall, the vibration thereof causing said molten material to form one or more streams of uniformly sized droplets;

a charging plate means having one or more further orifices provided adjacent to and insulatively spaced from said one chamber wall, said one or more further orifices corresponding to the one or more orifices of said one wall of said chamber;

a voltage source for applying a voltage to said charging plate so that as said one or more streams of droplets pass through said one or more further orifices, each droplet is electrically charged so as to maintain the size and shape of said droplets;

whereby one or more streams of charged droplets are supplied to a substrate for uniformly coating a surface thereof.

2. An apparatus in accordance with claim 1 wherein said molten material is molten metal.

3. An apparatus in accordance with claims 1 or 2 and further including means mounted between said source and said chamber for filtering said molten material to remove impurities therefrom.

4. An apparatus in accordance with claims 1 or 2 wherein the wall of said chamber having said one or more orifices and the charging plate means form a volume therebetween and further including means for flushing said volume with an inert gas to create an oxygen-free atmosphere therein.

5. An apparatus in accordance with claim 4 wherein said gas is nitrogen.

6. An apparatus in accordance with claims 1 or 2 wherein said vibrating means includes one or more piezoelectric transducers and one or more corresponding vibration carrying elements mounted between said piezoelectric transducer and a wall of said chamber opposite the wall thereof containing said one or more orifices; and means for causing said transducers to vibrate at a selected frequency.

7. An apparatus in accordance with claim 6 wherein said frequency is selected within a range from about 10 to 25 kilohertz.

8. An apparatus in accordance with claims 1 or 2 wherein said voltage is selected to lie within a range from about 300 to 500 volts.

9. An apparatus in accordance with claims 1 or 2 wherein said one or more orifices and said one or more further orifices each comprise a plurality of rows of orifices.

10. An apparatus in accordance with claim 9 wherein the rows of said orifices and said further orifices are arranged in a staggered configuration.

11. An apparatus in accordance with claim 10 wherein said rows of orifices and further orifices all have substantially the same diameters.

12. An apparatus in accordance with claims 9 or 10 wherein each said one or more orifices and said one or more further orifices in selected groups thereof have the same diameter, the selected diameters in any one group being different from the diameters in each other group.

13. An apparatus in accordance with claims 9 or 10 wherein the diameter of said orifices are selected to lie within a range from about 50–100 microns.

14. An apparatus in accordance with claim 13 wherein the spacings of said orifices from each other lie within a range from about 1 to 3 mm.

15. An apparatus in accordance with claims 1 or 2 wherein the pressure on said molten material in said chamber is selected so as to produce a velocity for said molten metal as it passes through said orifices which lies within a range from about 5 to 15 meters/second.

16. An apparatus in accordance with claims 1 or 2 wherein each of said source, said chamber, said supplying means, said heating means, said vibrating means, and said charging plate means is formed as a separate module so that said apparatus can be readily assembled therefrom and readily disassembled for easy replacement of one or more of said modules.

* * * * *